US008978626B2

(12) United States Patent
Ashford et al.

(10) Patent No.: US 8,978,626 B2
(45) Date of Patent: Mar. 17, 2015

(54) ON-BOARD VAPOR RECOVERY SYSTEM AND APPARATUS

(75) Inventors: Marcus Demetris Ashford, Tuscaloosa, AL (US); Daniel Timothy Daly, Tuscaloosa, AL (US); Scott Kevin Spear, Bankston, AL (US)

(73) Assignee: Board of Trustees of the University of Alabama, Tuscaloosa, AL (US)

( * ) Notice: Subject to any disclaimer, the term of this patent is extended or adjusted under 35 U.S.C. 154(b) by 676 days.

(21) Appl. No.: 13/146,502

(22) PCT Filed: Jan. 28, 2010

(86) PCT No.: PCT/US2010/022317

§ 371 (c)(1),
(2), (4) Date: Aug. 26, 2011

(87) PCT Pub. No.: WO2010/088328

PCT Pub. Date: Aug. 5, 2010

(65) Prior Publication Data

US 2011/0301823 A1 Dec. 8, 2011

Related U.S. Application Data

(60) Provisional application No. 61/147,945, filed on Jan. 28, 2009.

(51) Int. Cl.

| | |
|---|---|
| ***F02M 33/02*** | (2006.01) |
| ***F02D 41/00*** | (2006.01) |
| ***F02M 25/08*** | (2006.01) |

(52) U.S. Cl.

CPC ..... *F02D 41/0045* (2013.01); *F02D 41/0042* (2013.01); *F02M 25/089* (2013.01)

USPC ..... 123/518; 123/525

(58) Field of Classification Search

CPC F02M 25/08; F02M 25/0854; F02M 25/0836

USPC ..... 123/27 GE, 525, 528, 518, 575, 576; 60/278, 299, 283, 290, 297

See application file for complete search history.

(56) References Cited

U.S. PATENT DOCUMENTS 3,794,000 A 2/1974 Hodgkinson
3,807,377 A * 4/1974 Hirschler et al. ..... 123/575

(Continued)

FOREIGN PATENT DOCUMENTS

WO 2007098104 A2 8/2007

OTHER PUBLICATIONS

Alff et al., An Active Vapor Utilization System for Emissions Reductions in Gasoline-Fuelled Vehicles, Proceedings of the 2008 Technical Meeting of the Central Status Section of the Combustion Institution, pp. 1-6 (2008).

(Continued)

*Primary Examiner* — John Kwon
(74) *Attorney, Agent, or Firm* — Meunier Carlin & Curfman, LLC

(57) ABSTRACT

A vapor recovery system for an internal combustion engine is provided, the system having a fuel tank containing fuel and vapor that is in select fluid communication with an intake of the internal combustion engine, a compressor, a condensate tank, a condensate composition sensor, and an engine control unit. The engine control unit can be configured to select a desired operating mode for the internal combustion engine and to control the supply of condensate to the intake of the internal combustion engine based on the selected desired operating mode.

12 Claims, 3 Drawing Sheets

(56) References Cited

U.S. PATENT DOCUMENTS

| | | | | |
|---|---|---|---|---|
| 4,945,885 | A | 8/1990 | Gonze et al. | |
| 6,279,548 | B1 | 8/2001 | Reddy | |
| 6,526,950 | B2 | 3/2003 | Ito et al. | |
| 7,347,191 | B2 | 3/2008 | Atwood et al. | |
| 7,370,610 | B2 | 5/2008 | Ashford et al. | |
| 2005/0187681 | A1 | 8/2005 | Suzuki et al. | |
| 2006/0174698 | A1 | 8/2006 | Chung et al. | |
| 2007/0266632 | A1* | 11/2007 | Tsangaris et al. | 48/190 |
| 2010/0011746 | A1* | 1/2010 | Lupescu | 60/278 |
| 2010/0024396 | A1* | 2/2010 | Lupescu et al. | 60/284 |

OTHER PUBLICATIONS

Ashford et al., Further Development of an On-Board Distillation System for Generating a Highly Volatile Cold-Start Fuel, SI Combustion and Direct Injection SI Engine Technology, SP-1972, pp. 161-167, Society of Automotive Engineers, Warrendale, PA (2005).

Balabin et al., Quantitative Measurement of Ethanol Distribution over Fractions of Ethanol-Gasoline Fuel, Energy & Fuels, 21:2460-2465 (2007).

Chen et al., Densities, Viscosities, and Refractive Indices for Binary and Ternary Mixtures of Acetone, Ethanol, and 2,2,4-Trimethylpentane, J. Chem. Eng. Data, 50:1262-1269 (2005).

IOB et al., Determination of Oxygenates in Gasoline by FTIR, Fuel, 77(15):1861-1864 (1998).

International Search Report and Written Opinion for PCT/US2010/22317 dated May 3, 2010.

Kidokoro et al., Development of PZEV Exhaust Emission Control System, SAE 2003-01-0817.

Lyons et al., Evaporative Emissions from Late-Model In-Use Vehicles, SAE Paper No. 2000-01-2958.

Siegl et al., Identifying Sources of Evaporative Emissions—Using Hydrocarbon Profiles to Identify Emission Sources, SAE Paper No. 2000-01-1139.

Stanglmaier et al., Condensation of Fuel on Combustion Chamber Surfaces as a Mechanism for Increased HC Emissions During Cold Start, SAE Paper No. 1997-01-2884.

* cited by examiner

ON-BOARD VAPOR RECOVERY SYSTEM AND APPARATUS

CROSS-REFERENCE TO RELATED APPLICATIONS

This application claims priority to U.S. Provisional Patent Application Ser. No. 61/147,945, filed Jan. 28, 2009, which is hereby incorporated by reference in its entirety.

FIELD OF THE INVENTION

This invention relates generally to a fuel supply system for an internal combustion engine, particularly for use with a volatile fuel source. More particularly, the invention pertains to an on-board vapor recovery system for condensing gasoline vapors to form a volatile starting fuel and for controlling the operation of an internal combustion engine based on the composition of the fuel within the system.

BACKGROUND OF THE INVENTION

Hydrocarbon (HC) emissions are a well-known and persistent threat to the environment. Commonly emitted HC species include precursors to smog and agents that are acutely toxic to human, animal and plant life. Moreover, the U.S. Environmental Protection Agency (EPA) has reported that automobile sources contributed 44% of the national emissions inventory of volatile organic compounds (VOC) in 2002. U.S. Environmental Protection Agency Clearinghouse for Inventories & Emissions Factors, "Air Pollutant Emission Trends: 1970-2002 Average Annual Emissions, All Criteria Pollutants" (January 2005). As defined by the EPA, a volatile organic compound is "any compound of carbon, excluding carbon monoxide, carbon dioxide, carbonic acid, metallic carbides or carbonates, and ammonium carbonate, which participates in atmospheric photochemical reactions." 40 C.F.R. §51.100. Included in this definition are many smog-forming hydrocarbon species.

VOC emissions from modern vehicles are primarily the result of the incomplete combustion of fuel (tailpipe emissions) and the evaporation of fuel stored on-board (evaporative emissions). Tailpipe emissions are highest immediately after starting. At moderate temperatures (20-30° C.), only 10-30% of gasoline vaporizes to join the combustible fuel/air mixture. As liquid fuel does not burn, this necessitates generous over-fueling to provide robust starting. Much of the excess fuel escapes complete combustion and encounters the catalytic converter, which is very inefficient at operating temperatures below approximately 300-350° C. The period of highest tailpipe HC emissions coincides with the period of lowest catalyst conversion efficiency. Consequently, a high percentage of HC emissions occur during the starting and warm-up periods. In fact, between 60 and 95% of all tailpipe emissions occur during the cold-start period, which includes the first 60-90 seconds of engine operation after starting the vehicle. Ashford, M. D., and Matthews, R. D. "Further Development of an On-Board Distillation System for Generating a Highly Volatile Cold-Start Fuel," *SI Combustion and Direct Injection SI Engine Technology*, SP-1972, pp 161-167, Society of Automotive Engineers, Warrendale, Pa. (2005), the entire contents of which are incorporated herein by reference.

Research has demonstrated that use of a highly volatile fuel for cold-starting significantly reduces tailpipe HC emissions. See Kidokoro, T., Hoshi, K., Hiraku, K., Satoya, K., Watanabe, T., Fujiwara, T., and Suzuki, H., "Development of PZEV Exhaust Emission Control System," SAE 2003-01-0817, the entire contents of which is incorporated herein by reference. The vapor inside the fuel tank primarily contains the lightest and most volatile species present in gasoline. See Lyons, J., Lee, J., Heirigs, P., McClement, D., and Welstand, S., "Evaporative Emissions from Late-Model In-Use Vehicles," SAE Paper No. 2000-01-2958, the entire contents of which are incorporated herein by reference. In one study, speciation of vapor above liquid gasoline at 21° C. revealed that the vapor was dominated by three species—2-methylpropane (isobutane), n-butane, and 2-methylbutane (iso-pentane) collectively accounted for 78% of the vapor composition. See Siegl, W., Guenther, M. and Henney, T., "Identifying Sources of Evaporative Emissions—Using Hydrocarbon Profiles to Identify Emission Sources," SAE Paper No. 2000-01-1139, the entire contents of which are incorporated herein by reference. In one study, an on-board fuel preprocessor that collected highly volatile fractions of gasoline for use as starting fuel was successful at reducing overall tailpipe HC emissions by more than 80%. See Ashford, M. D., and Matthews, R. D. "Further Development of an On-Board Distillation System for Generating a Highly Volatile Cold-Start Fuel," *SI Combustion and Direct Injection SI Engine Technology*, SP-1972, pp 161-167, Society of Automotive Engineers, Warrendale, Pa. (2005). Further studies and research have demonstrated that the most desirable starting fuels are rich in HC species no heavier than $C_6$. See Stanglmaier, R., Roberts, C., Ezekoye, O. and Matthews, R., "Condensation of Fuel on Combustion Chamber Surfaces as a Mechanism for Increased HC Emissions During Cold Start," SAE Paper No. 1997-01-2884, the entire contents of which are incorporated herein by reference. Thus, vapor from a fuel tank is an ideal source for a starting fuel that is rich in light-weight and highly volatile HC species.

Although tailpipe emissions are substantial, evaporative HC emissions can be three to four times greater than tailpipe emissions during routine driving. Lyons, J., Lee, J., Heirigs, P., McClement, D., and Welstand, S., "Evaporative Emissions from Late-Model In-Use Vehicles," SAE Paper No. 2000-01-2958. Evaporative emissions can be broken down into several classifications, with running losses and refueling losses accounting for the vast majority of total evaporative emissions. Refueling losses occur when vapor is displaced by liquid entering the fuel tank, a common occurrence at service stations. Running losses occur when vapor is generated in response to heat from hot exhaust, hot pavement, a hot engine compartment, or another hot component of a running engine. Most fuel systems are "return" style systems that supply a large amount of fuel to injectors while returning the excess fuel to the fuel tank. This excess fuel helps keep engine-bay fuel temperatures low, reducing vapor generation and the chance of vapor lock. However, the returning fuel is warmed during its trip through the engine-bay. Also, rear mounted fuel tanks are located in close proximity to hot exhaust pipes, which can be a potent heat source, especially in stop and go traffic. Thus, even though modern fuel return systems help to reduce the amount of vapor generation, a substantial amount of vapor continues to be generated due to heat sources surrounding the fuel tank.

Other classifications of evaporative emissions include diurnal emissions and hot soaks. Diurnal emissions occur when vapor is generated in response to daytime increases in ambient temperature. For example, gasoline tanks may receive considerable heat input via radiation from a hot pavement. In addition, hot soaks occur when vapor is generated due to high temperatures that result from a lack of circulating air or engine coolant after shutdown. Following shutdown, vehicles actually tend to warm up somewhat (especially under the hood) because of a loss of the cooling effect of air flow and water circulation. Naturally, the fuel system is warmed, resulting in the hot soak emissions. These hot soak vapors can become trapped in the fuel system and cause fuel system vapor lock during hot restarts.

The industry-standard solution for preventing the atmospheric release of excess fuel vapor is to collect the vapors in a canister filled with an activated charcoal adsorbent before combusting the vapors when engine operating conditions are favorable. This related art system is shown in FIG. 1. This is an imperfect solution for several reasons. First, diurnal, refueling and hot soak emissions occur when the engine is off. Therefore, when the carbon adsorbent becomes saturated (e.g., several consecutive diurnal cycles with no canister purge), vapors will be released to the atmosphere (canister breakthrough). Second, running loss emissions result when vapor is generated at a very high rate (such as during sloshing), exceeding the adsorption capability of a typical passive vapor-adsorbing system. Finally, the desorbed vapors inducted by the engine include a considerable—but unknown—quantity of air. This fuel/air mixture of unknown strength can upset the delicate air/fuel balance necessary to provide low-emission combustion and smooth engine operation. For this reason, the vapor canister is seldom purged during starting or at idle, where the consequences of engine upsets are most severe.

All of the aforementioned factors ultimately result in higher HC emissions. However, several approaches to reducing evaporative emissions exist. So called "returnless" fuel systems reduce running losses by eliminating the return of warm fuel from the engine bay. Newer fuel tanks are vented through the filler neck such that fuel vapors can be recovered by specially equipped fuel station pumps, reducing refueling losses. The newest, cleanest cars in the world (California PZEV-level) are certified to generate zero fuel based evaporative emissions. These vehicles combine returnless fuel systems with highly adsorbent carbon canisters.

Nevertheless, evaporative emissions still represent a significant portion of total vehicular VOC emissions. Despite a decrease in allowable tail pipe emissions by three orders of magnitude over the last thirty years, actual HC emissions have decreased by approximately 80% on a car-by-car basis. Factoring in the increase in vehicle miles traveled over the same period, the aggregate mobile-source HC emissions have only decreased by about half. Furthermore, older vehicles that are not subject to regulations issued after the date of their manufacture may have disproportionately higher emissions as compared to newer vehicles.

It is known that passive starting systems can be incorporated into automobiles to induct hydrocarbon vapors from the carbon canister. A major concern with these systems is the limited production of fuel vapor in cold weather conditions. Under conditions where ambient temperatures are low and there is limited thermal driving force for fuel evaporation, such as, for example, during winter months, the production of fuel vapor is diminished. However, volatile species are added to gasoline in cold climates to enhance cold-start performance, and this increased volatility compensates for the decrease in fuel vapor. However, these systems also suffer from fundamental imperfections. First, there is no way to conclusively know the amount of vapor that can be drawn from the canister. Second, the vapors inducted from the carbon canister are mixed with air, creating a mixture of unknown strength. Thus, these systems are unsuitable for cold-starting, when predictable and robust fueling is essential.

Active recovery of fuel vapor is believed to allow for simultaneous reductions in tailpipe and evaporative emissions. As previously discussed, use of the highly volatile components of fuel vapor as a starting fuel can greatly reduce tailpipe emissions. Thus, it is believed that an effective starting fuel for this purpose can be composed of condensed fuel vapor, which can be stored in isolation and include the most volatile HC species. In addition to the condensate formed from fuel vapor, active vapor recovery can also generate air and trace hydrocarbons that can be stored in a typical vapor canister. It is believed that the separation of the vapor from air will greatly reduce the amount of evaporative hydrocarbon emissions when compared to a normal fuel system.

Given the increasing prevalence of alternative fuels, modern fuel systems and internal combustion engines that are capable of operating with multiple starting fuels are believed to be preferable to fuel systems that are designed to operate with only a single starting fuel. Thus, it is believed that a modern fuel system and internal combustion engine should preferably have multiple operating modes that are adjusted in response to the sensed composition of fuel within the fuel supply system. These multiple operating modes are believed to allow for optimized engine performance regardless of the composition of the fuel used to operate the engine.

Accordingly, it is desirable in the pertinent art to provide an on-board vapor recovery system for use with a fuel supply system and an internal combustion engine that addresses the limitations associated with known systems, including but not limited to those limitations discussed above. Specifically, it is desirable in the pertinent art to provide a vapor-recovery system that can capture, store, and use isolated fuel vapors as a highly volatile fuel source. In addition, it is desirable in the pertinent art to provide an engine control unit for use with a fuel supply system and an internal combustion engine that can select the fuel source and desired operating mode of the internal combustion engine based on the composition of fuel and/or vapor at different locations within the fuel supply system.

SUMMARY

In one embodiment of the present invention, a method for controlling the operation of an internal combustion engine in fluid communication with a fuel tank comprises sensing the composition of fuel therein the fuel tank and providing an engine control unit operably coupled to the internal combustion engine, where the engine control unit is configured to select a desired operating mode for the internal combustion engine from a plurality of operating modes of the internal combustion engine based at least on the sensed composition of fuel therein the fuel tank.

In another embodiment of the present invention, a vapor recovery system for an internal combustion engine having a fuel tank comprises a compressor, a condensate tank, a condensate composition sensor, and an engine control unit that selects a desired operating mode of the internal combustion engine based on at least a condensate composition signal and controls the supply of condensate to the internal combustion engine.

Related methods of operation are also provided. Other systems, methods, features, and advantages of the vapor recovery system will be or become apparent to one with skill in the art upon examination of the following figures and detailed description. It is intended that all such additional systems, methods, features, and advantages be included within this description, be within the scope of the vapor recovery system, and be protected by the accompanying claims.

DESCRIPTION OF THE FIGURES

The accompanying drawings, which are incorporated in and constitute a part of this specification, illustrate certain aspects of the instant invention and together with the description, serve to explain, without limitation, the principles of the invention.

DESCRIPTION OF THE INVENTION

Figure 1:
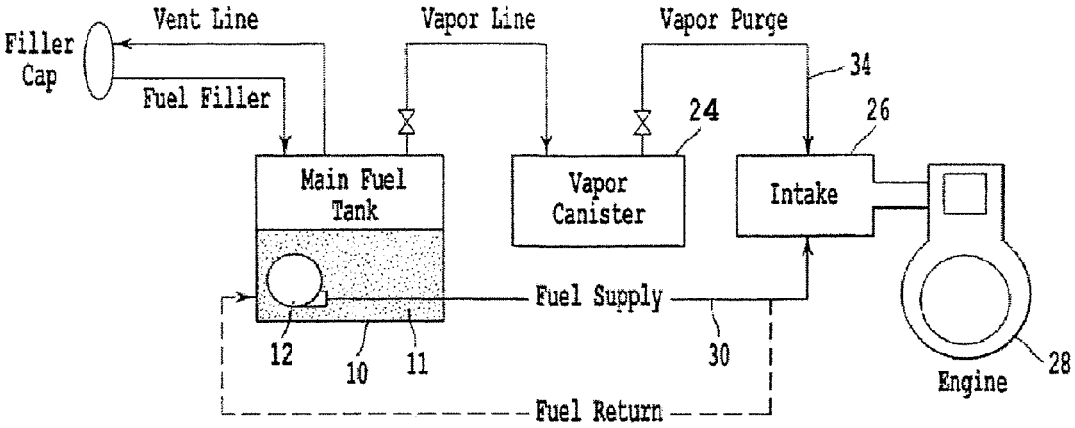
Fig. 1 (Prior Art)
FIG. 1 is a schematic of a prior art fuel vapor recovery system.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "bore" includes aspects having two or more bores unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

In one embodiment, the present invention comprises a method for controlling the operation of an internal combustion engine 28 that is in fluid communication with a fuel tank 10. In one aspect, a means for sensing the composition of fuel therein the fuel tank is in communication with an engine control unit 32 that is operably coupled to the internal combustion engine. In one aspect, the fuel tank 10 can contain a volatile fuel 11, such as, for example and without limitation, gasoline. Of course, it is contemplated that the fuel tank can contain any suitable volatile fuel, including alternative fuel sources.

In one aspect, the engine control unit 32 can be implemented in a programmed general purpose computer. However, it is contemplated that the engine control unit 32 can be a special purpose computer, a program microprocessor or microcontroller with peripheral integrated circuit elements, an ASIC or other integrated circuit, a digital signal processor, a hard-wired electronic or logic circuit, such as a discrete element circuit, a programmable logic device, such as a PLD, PLA, FPGA, or PAL, or any other device capable of implementing the described controls. The engine control unit 32 can be included in a new control unit of a vehicle, or a vehicle can be retrofitted with the engine control unit.

In one aspect, the engine control unit 32 can be configured to select a desired operating mode for the internal combustion engine 28 from a plurality of operating modes of the internal combustion engine based at least on the sensed composition of fuel therein the fuel tank. As one having ordinary skill in the pertinent art will appreciate, pressure, temperature, and other characteristics of the fuel therein the fuel tank can also be used to select a desired operating mode for the internal combustion engine 32. As one having ordinary skill in the pertinent art will further appreciate, the plurality of operating modes can allow the internal combustion engine to operate in an efficient manner with multiple fuel types.

Figure 2:
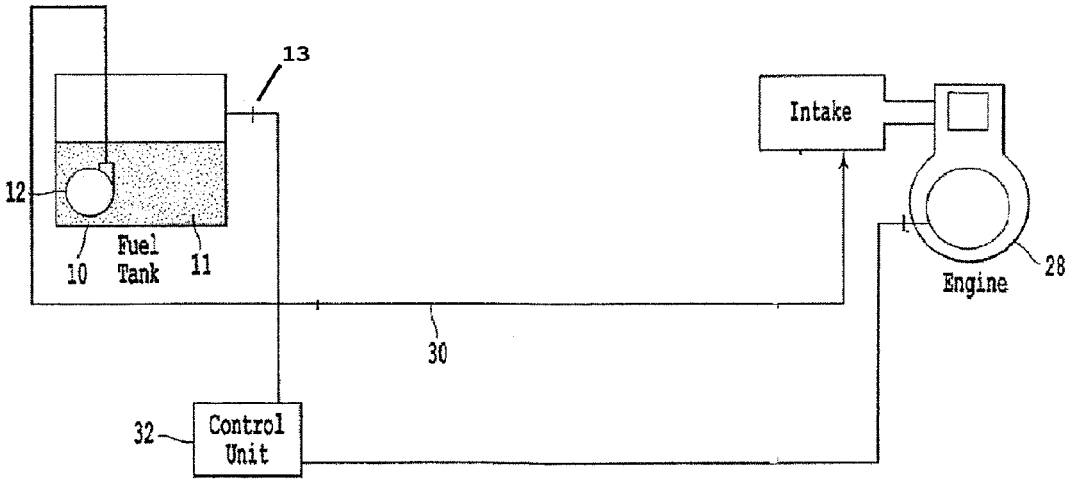
FIG. 2 is a schematic of a first embodiment of the present invention showing a performance optimization system for an internal combustion engine having a fuel tank in communication with the internal combustion engine, showing a fuel composition sensor and an engine control unit.

In one embodiment of the present invention, and referring to FIG. 2, a performance optimization system for an internal combustion engine 28 has a fuel tank 10 in communication with an intake 26 of the internal combustion engine. In one aspect, the fuel tank 10 can comprise a fuel pump 12 for pumping fuel through a fuel line 30 to intake 26 of the internal combustion engine 28. In another aspect, the performance optimization system can comprise a fuel composition sensor 13 comprising means for sensing the composition of fuel therein the fuel tank. Optionally, and without limitation, it is contemplated that the means for sensing the composition of fuel can use electrochemical, refractive index, or infra-red spectroscopy analysis tools to record information about the composition of the fuel. Specifically, these techniques can enable a sensor to sense the gasoline-ethanol blend compositional data for volatile fuels. See Balabin, et al., "Quantitative Measurement of Ethanol Distribution over Fractions of Ethanol-Gasoline Fuel," 21 Energy & Fuels 2460-2465 (2007); Chen, et al., "Densities, Viscosities, and Refractive Indices for Binary and Ternary Mixtures of Acetone, Ethanol, and 2,2,4-Trimethylpentane," 50 J. Chem. Eng. Data 1262-1269 (2005); Iob, et al., "Determination of Oxygenates in Gasoline by FTIR," 77(15) Fuel 1861-1864 (1998). An example of a refractive index sensor that could potentially be used for these purposes is the FRI Refractive Index Sensor, manufactured by FISO Technologies, Inc. However, it is contemplated that any means for sensing the gasoline-ethanol blend compositional data of fuel can be used for these purposes.

In another aspect, as shown in FIG. 2, the performance optimization system can comprise an engine control unit 32 that is operably coupled to the internal combustion engine 28 and in communication with the fuel composition sensor 13 for receiving a fuel composition signal therefrom that is indicative of the sensed composition of fuel 11 therein the fuel tank 10. In this aspect, the engine control unit 32 can be configured to select a desired operating mode for the internal combustion engine 28 from a plurality of operating modes of the internal combustion engine 28 based at least on the fuel composition signal. As one having ordinary skill in the pertinent art will appreciate, it is contemplated that pressure, temperature, and other characteristics of the fuel 11 therein the fuel tank 10 can also be used to select a desired operating mode for the internal combustion engine 28. In a further aspect, the engine control unit 32 can be configured to control the supply of at least fuel to the intake 26 of the internal combustion engine 28 based on the selected desired operating mode.

Figure 3:
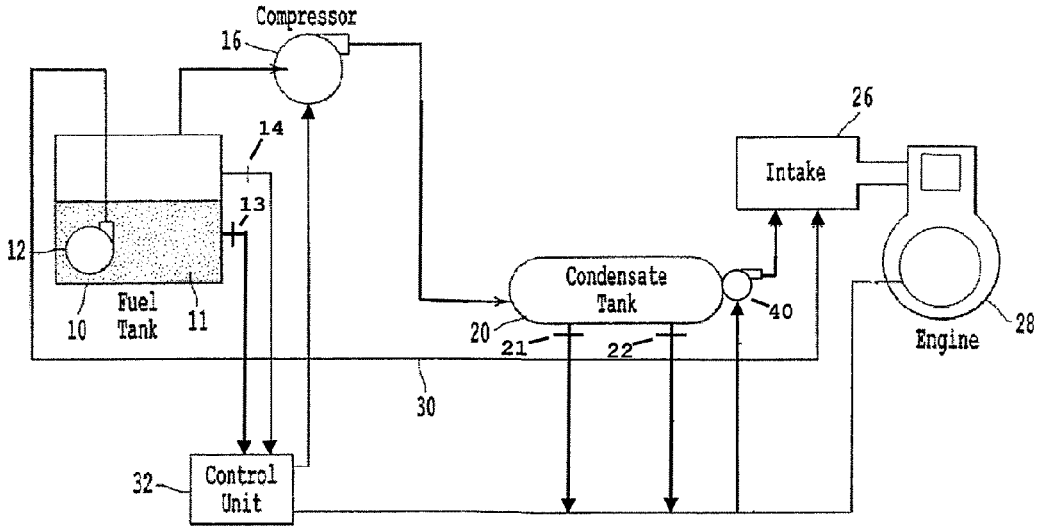
FIG. 3 is a schematic of a second embodiment of the present invention showing a vapor recovery system for an internal combustion engine having a fuel tank that is in select fluid communication with the intake of the internal combustion engine, showing a compressor, a condensate tank, a condensate composition sensor, and an engine control unit.

In another embodiment, as shown in FIG. 3, the present invention comprises a vapor recovery system for an internal combustion engine 28 having a fuel tank 10 containing fuel 11 and vapor that is in select fluid communication with an intake 26 of the internal combustion engine. In one aspect, the fuel tank 10 can comprise a fuel pump 12 for pumping fuel through a fuel line 30 to intake 26 of the internal combustion engine 28. In another aspect, the vapor recovery system comprises a compressor 16 in fluid communication with the vapor of the fuel tank 10 and configured to generate a compressed fluid. As one having ordinary skill in the pertinent art will appreciate, the compressor 16 can generate vapor and other by-products in addition to the compressed fluid. In another aspect, the vapor recovery system can comprise a condensate tank 20 in fluid communication with the compressor 16 and the intake 26 of the internal combustion engine 28. In this aspect, the condensate tank 20 can be configured to store pressurized condensate and is positioned downstream of the compressor 16 and upstream of the intake 26.

In another aspect, the vapor recovery system can comprise a condensate composition sensor 21 comprising means for sensing the composition of the condensate therein the condensate tank 20. An mentioned above with regard to the fuel composition sensor, it is contemplated, without limitation, that the means for sensing the composition of condensate can use electrochemical, refractive index, infra-red spectroscopy, or other suitable analysis tools to sense the gasoline-ethanol blend compositional data for volatile fuels. An example of a refractive index sensor that could potentially be used for these purposes is the FRI Refractive Index Sensor, manufactured by FISO Technologies, Inc.

In an additional aspect, and referring to FIG. 3, the vapor recovery system can comprise an engine control unit 32 that is operably coupled to the internal combustion engine 28 and in communication with the condensate composition sensor 21 for receiving a condensate composition signal therefrom that is indicative of the sensed composition of condensate therein the condensate tank 20. As one having ordinary skill in the pertinent art will appreciate, the pressurized condensate is stored as a highly volatile starting fuel that can be used during cold starts of the internal combustion engine. Moreover, the communication between the condensate composition sensor and the engine control unit enables the internal combustion engine to make use of fuel-air mixtures of known strength during starting. As one having ordinary skill in the pertinent art will further appreciate in light of the volatility increase in the fuel available to consumers during the colder months of the year, sufficient fuel vaporization can occur during cold weather operation of the vapor recovery system to permit year-round use of the vapor recovery system. In one exemplary aspect, the engine control unit 32 can be configured to select a desired operating mode for the internal combustion engine 28 from a plurality of operating modes of the internal combustion engine 28 based at least on the condensate composition signal. As one having ordinary skill in the pertinent art will appreciate, and without limitation, pressure, temperature, and other characteristics of the condensate therein the condensate tank can also be used to select a desired operating mode for the internal combustion engine 28. In a further aspect, the engine control unit 32 can be configured to control the supply of the pressurized condensate to the intake 26 of the internal combustion engine 28 based on the selected desired operating mode. For example, condensate can be supplied through the use of a pressure differential between the condensate tank 20 and the intake 26 of the internal combustion engine 28.

In one aspect, as shown in FIG. 3, the vapor recovery system can further comprise a condensate tank pressure sensor 22 in communication with the engine control unit 32. In this aspect, the engine control unit 32 can be configured to receive a condensate tank pressure signal indicative of the sensed pressure of condensate therein the condensate tank 20. In a further aspect, the desired operating mode for the internal combustion engine 28 can be selected based on at least one of the condensate composition signal and the condensate tank pressure signal.

In another aspect, and referring to FIG. 3, the vapor recovery system can further comprise a fuel composition sensor 13 comprising means for sensing the composition of fuel 11 therein the fuel tank 10. As described above, it is contemplated that the means for sensing the composition of fuel can use, without limitation, electrochemical, refractive index, infra-red spectroscopy, or other suitable analysis tools to sense the gasoline-ethanol blend compositional data for volatile fuels. An example of a refractive index sensor that could potentially be used for these purposes is the FRI Refractive Index Sensor, manufactured by FISO Technologies, Inc. In one aspect, the engine control unit 32 can be configured to receive a fuel tank composition signal indicative of the sensed composition of fuel 11 therein the fuel tank 10. In a further aspect, the desired operating mode for the internal combustion engine 28 can be selected based on at least one of the fuel tank composition signal, the condensate composition signal, and the condensate tank pressure signal. As one having ordinary skill in the pertinent art will appreciate, temperature and other characteristics of the condensate and fuel therein the condensate and fuel tanks can also be used to select the desired operating mode.

Optionally, fuel can be directed from both the fuel tank 10 and the condensate tank 20 to the intake of the internal combustion engine 28. It is also contemplated that a vehicle using the vapor recovery system can be wholly started by using condensate as its fuel source so as to significantly reduce cold start emissions. In addition, it is contemplated that the engine control unit 32 can begin to direct fuel 11 from the fuel tank 10 into the intake 26 of the internal combustion engine 28 approximately 30 to 60 seconds following a cold start accomplished solely through the use of condensate. It is further contemplated that fuel 11 from the fuel tank 10 and condensate from the condensate tank 20 can be simultaneously directed into the intake 26 of the internal combustion engine 28 by the engine control unit 32 to produce a desired volatile fuel mixture.

Figure 4:
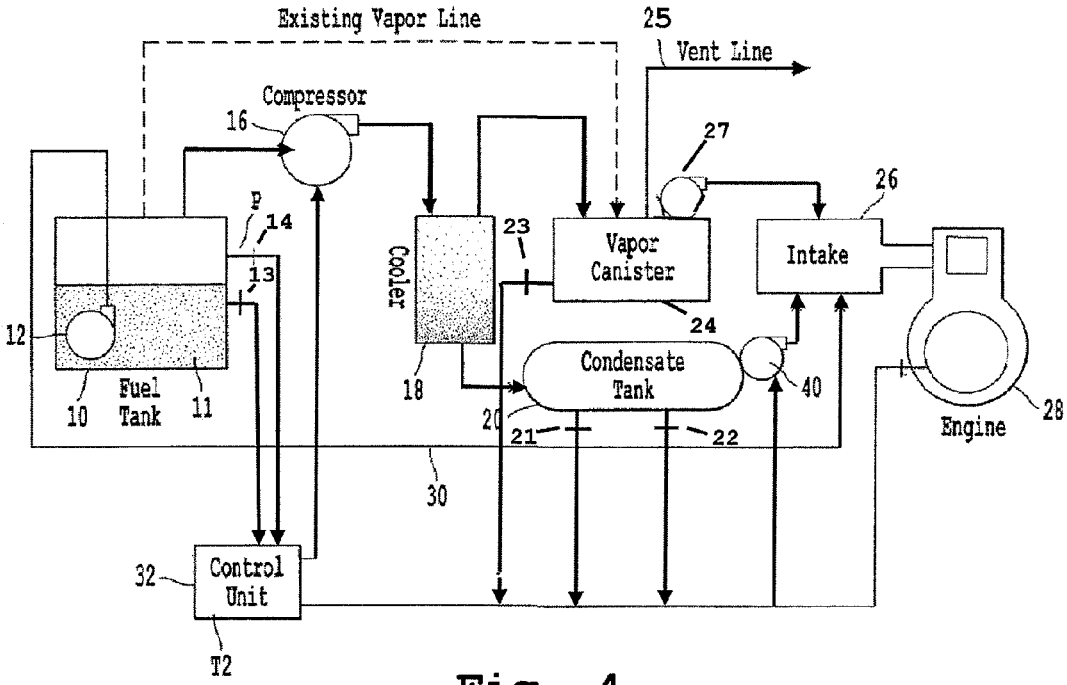
FIG. 4 is a schematic of a third embodiment of the present invention showing the vapor recovery system of FIG. 3 with a cooler and vapor canister.

In one exemplary aspect, as depicted in FIGS. 3 and 4, the vapor recovery system can further comprise a first valve 40 positioned therebetween the condensate tank 20 and the intake 26 of the internal combustion engine 28. In this embodiment, the first valve 40 can be configured to selectively allow communication of pressurized condensate from the condensate tank 20 to the intake 26 of the internal combustion engine 28. In one aspect, the first valve 40 can be in operative communication with the engine control unit 32. In a further aspect, the engine control unit 32 can be configured to selectively open the first valve 40 in response to the selected desired operating mode for the internal combustion engine 28.

In a further aspect, as shown in FIG. 3, the vapor recovery system can further comprise a fuel tank pressure sensor 14 in communication with the engine control unit 32. In one aspect, the engine control unit 32 can be configured to receive a fuel tank pressure signal indicative of the sensed pressure of fuel 11 therein the fuel tank 10. In a further aspect, the desired operating mode for the internal combustion engine 28 can be selected based on at least one of the fuel tank pressure signal, the fuel tank composition signal, the condensate composition signal, and the condensate pressure signal. As one having ordinary skill in the pertinent art will appreciate, temperature and other characteristics of the condensate and fuel therein the condensate and fuel tanks can also be used to select the desired operating mode. As one having ordinary skill in the pertinent art will further appreciate, due to the placement of the vapor recovery system between existing engine components, the vapor recovery system can easily be retrofit to existing vehicles.

In another aspect, and referring to FIG. 4, the vapor recovery system can further comprise means for generating a condensate from the compressed fluid exiting the compressor 16. For example, and without limitation, the means for generating a condensate from the compressed fluid can comprise a 500 Watt condenser. In this aspect, the means for generating a condensate can be positioned downstream of the compressor 16 and upstream of the condensate tank 20. In one aspect, the means for generating a condensate can allow for the generation of at least some vapor. In this aspect, the vapor generated by the means for generating a condensate can be in fluid communication with the intake 26 of the internal combustion engine 28. In another aspect, as shown in FIG. 4, the vapor recovery system can further comprise a vapor canister 24 positioned therebetween and in fluid communication with the at least some vapor of the means for generating a condensate and the intake 26 of the internal combustion engine 28. The vapor canister 24, which can comprise an activated charcoal adsorbent, can collect vapor that would otherwise be released as evaporative emissions. In another aspect, the vapor generated by the means for generating a condensate can be in fluid communication with the atmosphere. In this aspect, the vapor canister 24 can comprise a vent line 25 configured to permit fluid communication between the vapor therein the vapor canister and the atmosphere.

In a further aspect, as shown in FIG. 4, the means for generating a condensate from the compressed fluid exiting the compressor 16 can comprise a cooler 18. The cooler 18 can cool fuel vapors at temperatures below the dew point of the most volatile hydrocarbon fuels. Additionally, it is contemplated that the cooler 18 can be configured as a thermoelectric heat pump, such as, for example and without limitation, Peltier elements. Alternatively, the means for generating a condensate from the compressed fluid exiting the compressor 16 can comprise membrane separation. It is contemplated that any means for generating a condensate from fuel vapor and separating vapor and air from the condensate can be used for this purpose.

In one aspect, and referring to FIG. 4, the vapor recovery system can further comprise a vapor canister composition sensor 23 comprising means for sensing the composition of vapor inside the vapor canister 24. It is contemplated that the means for sensing the composition of vapor can use, without limitation, electrochemical, refractive index, infra-red spectroscopy, or other suitable analysis tools to sense the gasoline-ethanol blend compositional data for volatile fuels. In this aspect, the engine control unit 32 can be configured to receive a vapor canister composition signal indicative of the sensed composition of vapor therein the vapor canister 24. In another aspect, the desired operating mode for the internal combustion engine 28 can be selected based on at least one of the vapor canister composition signal, the fuel tank pressure signal, the fuel tank composition signal, the condensate composition signal, and the condensate tank pressure signal. As one having ordinary skill in the pertinent art will appreciate, temperature and other characteristics of the condensate, fuel, and vapor therein the condensate and fuel tanks and the vapor canister can also be used to select the desired operating mode.

In another aspect, as shown in FIG. 4, the vapor recovery system can further comprise a second valve 27 positioned therebetween the vapor canister 24 and the intake 26 of the internal combustion engine 28. In one aspect, the second valve 27 can be configured to selectively allow communication of vapor from the vapor canister 24 to the intake 26 of the internal combustion engine 28. In this aspect, the second valve 27 can be in operative communication with the engine control unit 32. In a further aspect, the engine control unit 32 can be configured to selectively open the second valve 27 in response to the selected desired operating mode for the internal combustion engine 28.

Figure 5:
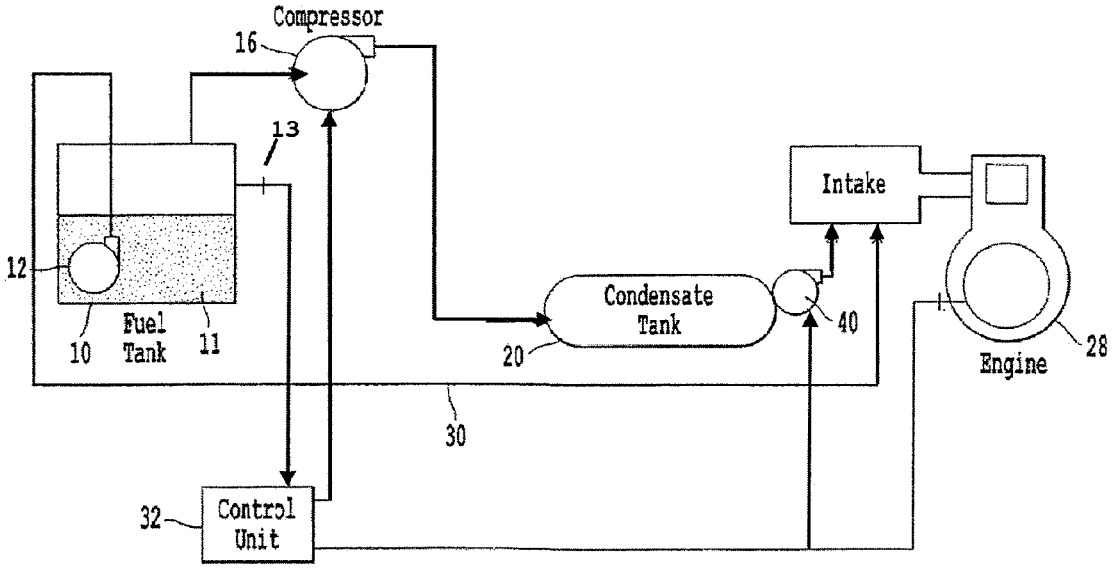
FIG. 5 is a schematic of a fourth embodiment of the present invention showing a vapor recovery system for an internal combustion engine having a fuel tank that is in select fluid communication with the intake of the internal combustion engine and showing a compressor, a condensate tank, a fuel composition sensor, and an engine control unit.

In one embodiment, as shown in FIG. 5, a vapor recovery system for an internal combustion engine 28 has a fuel tank 10 containing fuel 11 and vapor that is in select fluid communication with an intake 26 of the internal combustion engine 28. In this embodiment, a compressor 16 can be in fluid communication with the vapor of the fuel tank 10 and configured to generate a compressed fluid. In one aspect, the fuel tank 10 can comprise a fuel pump 12 for pumping fuel through a fuel line 30 to intake 26 of the internal combustion engine 28. In another aspect, a condensate tank 20 can be in fluid communication with the compressor 16 and the intake 26 of the internal combustion engine 28. In this aspect, the condensate tank 20 can be configured to store pressurized condensate and positioned downstream of the compressor 16 and upstream of the intake 26. In an exemplary aspect, a fuel composition sensor 13 can comprise means for sensing the composition of the fuel 11 and vapor therein the fuel tank 10. It is contemplated that the means for sensing the composition of fuel and vapor can use, without limitation, electrochemical, refractive index, infra-red spectroscopy, or other suitable analysis tools to sense the gasoline-ethanol blend compositional data for volatile fuels.

In another aspect, and as shown in FIG. 5, an engine control unit 32 can be operably coupled to the internal combustion engine 28 and in communication with the fuel communication sensor 13 for receiving a fuel composition signal therefrom indicative of the sensed composition of fuel 11 and vapor therein the fuel tank 10. In a further aspect, the engine control unit 32 can be configured to select a desired operating mode for the internal combustion engine 28 from a plurality of operating modes of the internal combustion engine based at least on the fuel composition signal. As one having ordinary skill in the pertinent art will appreciate, pressure, temperature and other characteristics of the fuel therein the fuel tank can also be used to select a desired operating mode for the internal combustion engine 28. In still a further aspect, the engine control unit 32 can be configured to control the selective operation of the compressor 16 based on the selected desired operating mode for the internal combustion engine 28. It is contemplated that the vapor recovery system can operate without the engine running, even while the vehicle is sitting in a driveway. Specifically, it is contemplated that the vapor recovery system can be powered by a vehicle battery during refuelling so as to remain in operation during refuelling. As one having ordinary skill in the pertinent art will appreciate, the operation of the vapor recovery system during refuelling drastically reduces evaporative losses by preventing the escape of vapor from the fuel tank 10 into the atmosphere.

In a further aspect, a fuel exhaust sensor can comprise means for sensing the completeness of combustion of fuel therein the internal combustion engine 28. In this aspect, the engine control unit 32 can be operably coupled to the internal combustion engine 28 and in communication with the fuel exhaust sensor for receiving a fuel combustion signal therefrom indicative of the completeness of combustion therein the internal combustion engine. In this aspect, the engine control unit 32 can be configured to select a desired operating mode for the internal combustion engine 28 from a plurality of operating modes of the internal combustion engine based at least on the fuel combustion signal. As one having ordinary skill in the pertinent art will appreciate, fuel composition, pressure, temperature and other characteristics of the fuel therein the fuel tank can also be used to select a desired operating mode for the internal combustion engine 28.

What is claimed is:

1. A vapor recovery system for an internal combustion engine having a fuel tank containing fuel and vapor that is in select fluid communication with an intake of the internal combustion engine, comprising:

a compressor in fluid communication with the vapor of the fuel tank and configured to generate a compressed fluid;

a condensate tank in fluid communication with the compressor and the intake of the internal combustion engine, wherein the condensate tank is configured to store pressurized condensate and is positioned downstream of the compressor and upstream of the intake;

a condensate composition sensor comprising means for sensing the composition of the condensate therein the condensate tank;

an engine control unit operably coupled to the internal combustion engine and in communication with the condensate composition sensor for receiving a condensate composition signal therefrom at least at engine start up indicative of the sensed composition of condensate therein the condensate tank, the engine control unit configured to:

select a desired operating mode for the internal combustion engine from a plurality of operating modes of the internal combustion engine based at least on the condensate composition signal; and control the supply of the pressurized condensate to the intake of the internal combustion engine based on the selected desired operating mode.

2. The vapor recovery system of claim 1, further comprising a condensate tank pressure sensor in communication with the engine control unit, wherein the engine control unit is configured to receive a condensate tank pressure signal indicative of the sensed pressure of condensate therein the condensate tank, and wherein the desired operating mode is selected based on at least one of the condensate composition signal and the condensate tank pressure signal.

3. The vapor recovery system of claim 2, further comprising a fuel composition sensor comprising means for sensing the composition of fuel therein the fuel tank, wherein the engine control unit is configured to receive a fuel tank composition signal indicative of the sensed composition of fuel therein the fuel tank, and wherein the desired operating mode is selected based on at least one of the fuel tank composition signal, the condensate composition signal, and the condensate tank pressure signal.

4. The vapor recovery system of claim 3, further comprising a fuel tank pressure sensor in communication with the engine control unit, wherein the engine control unit is configured to receive a fuel tank pressure signal indicative of the sensed pressure of fuel therein the fuel tank, and wherein the desired operating mode is selected based on at least one of the fuel tank pressure signal, the fuel tank composition signal, the condensate composition signal, and the condensate tank pressure signal.

5. The vapor recovery system of claim 4, further comprising a means for generating a condensate from the compressed fluid exiting the compressor, wherein the means for generating a condensate is positioned downstream of the compressor and upstream of the condensate tank.

6. The vapor recovery system of claim 5, wherein the means for generating a condensate allows for the generation of at least some vapor, and wherein the vapor generated by the means for generating a condensate is in fluid communication with the intake of the internal combustion engine.

7. The vapor recovery system of claim 6, further comprising a vapor canister positioned therebetween and in fluid communication with the at least some vapor of the means for generating a condensate and the intake of the internal combustion engine.

8. The vapor recovery system of claim 5, wherein the means for generating a condensate allows for the generation of at least some vapor, and wherein the vapor generated by the means for generating a condensate is in fluid communication with the atmosphere.

9. The vapor recovery system of claim 5, wherein the means for generating a condensate from the compressed fluid exiting the compressor comprises a cooler.

10. The vapor recovery system of claim 2, further comprising a first valve positioned therebetween the condensate tank and the intake of the internal combustion engine, wherein the first valve is configured to selectively allow communication of pressurized condensate from the condensate tank to the intake of the internal combustion engine, wherein the first valve is in operative communication with the engine control unit, and wherein the engine control unit is configured to selectively open the first valve in response to the selected desired operating mode.

11. The vapor recovery system of claim 7, further comprising a vapor canister composition sensor comprising means for sensing the composition of vapor inside the vapor canister, wherein the engine control unit is configured to receive a vapor canister composition signal indicative of the sensed composition of vapor therein the vapor canister, and wherein the desired operating mode is selected based on at least one of the vapor canister composition signal, the fuel tank pressure signal, the fuel tank composition signal, the condensate composition signal, and the condensate tank pressure signal.

12. The vapor recovery system of claim 11, further comprising a second valve positioned therebetween the vapor canister and the intake of the internal combustion engine, wherein the second valve is configured to selectively allow communication of vapor from the vapor canister to the intake of the internal combustion engine, wherein the second valve is in operative communication with the engine control unit, and wherein the engine control unit is configured to selectively open the second valve in response to the selected desired operating mode.

* * * * *